United States Patent [19]

Matsugu et al.

[11] 4,206,551

[45] Jun. 10, 1980

[54] UNIVERSAL PARALLEL RULER FOR THREE-DIMENSIONAL DRAWING

[75] Inventors: Youichi Matsugu; Yoshitaka Gibu, both of Wakou, Japan; Asahi Seimitsu Kabushiki Kaisha, 03, Tokyo, Japan

[73] Assignee: Asahi Seimitsu Kabushiki Kaisha, Tokyo, Japan

[21] Appl. No.: 971,096

[22] Filed: Dec. 19, 1978

[30] Foreign Application Priority Data

Dec. 21, 1977 [JP] Japan ..... 52-154149

[51] Int. Cl.[2] ..... B43L 13/14

[52] U.S. Cl. ..... 33/434

[58] Field of Search ..... 33/77, 76 V, 79 R, 79 A, 33/79 B, 79 C, 79 D, 98, 115, 120, 432, 433, 434

[56] References Cited

FOREIGN PATENT DOCUMENTS 1033093 6/1958 Fed. Rep. of Germany ..... 33/79 R 761930 11/1956 United Kingdom ..... 33/77

*Primary Examiner*—Harry N. Haroian

*Attorney, Agent, or Firm*—Birch, Stewart, Kolasch & Birch

[57] ABSTRACT

A Universal parallel ruler for use with three-dimensional drawings is disclosed which utilizes a pair of perpendicular scales individually secured to a mounting plate which is connected to a head portion. The head portion contains a plurality of preset stoppers which are angularly adjustable relative to the angular position of the respective axes of the three-dimensional drawing. Once each of the preset stoppers are angularly adjusted to their proper angular positions, clamp members secure each of the preset stoppers in position within the head portion. A locking piece is then utilized to disengage the head portion from one preset stopper allowing the head portion to be rotated to another preset stopper. Releasing the locking piece re-engages the head portion to another preset stopper and thus in alignment with another axis of the three-dimensional drawing.

10 Claims, 8 Drawing Figures

UNIVERSAL PARALLEL RULER FOR THREE-DIMENSIONAL DRAWING

BACKGROUND AND SUMMARY OF THE INVENTION

The present invention generally relates to a universal parallel ruler for use with a three-dimensional drawing such as an isometric projection, a dimetric projection or anisometric projection. Basically, the three-dimensional drawing is defined by three planes and all the circles contained in these three planes, corresponding to holes, shafts, etc., are drawn in ellipses. Each ellipse is determined by the ratio of its major and minor axes and the practical operation of drafting is performed using a template including many ellipses of various ratios arranged therein. In the universal parallel ruler for three-dimensional drawing of prior art, in which three scales correspond to the basic three axes, one of the serious problems relates to the fact that the three scales interfere with one another for effective use of the template. Each of the ellipses drawn in the basic three planes is determined by major and minor axes which are always perpendicular to each other. In view of these aspects, a universal parallel ruler having two scales always held perpendicular to each other will be extremely advantageous for use with a three-dimensional drawing in that the template can be used without any interference with the scales and that the respective basic three axes and lines transverse to each of these basic three axes can be immediately obtained.

The means to set the scales at an interval of 15° or 30° by cooperation of the index plate is mounted on the head support and a locking pawl is provided on the movable part of the head (i.e., on the scale side) of a universal parallel ruler. But this type of ruler has two scales at intermediate angles which correspond neither to 15° nor to 30°. The same problem remains even when the index plate is movably arranged and adapted to be fixed at an optional position relative to its associated support, since only one of the basic three axes could be position-set. The other two axes have positions which vary for every three-dimensional drawing.

In accordance with the present invention, the problem as described just above is overcome by an arrangement such that the head is provided with preset stoppers principally adapted to be optionally position-adjusted according to the basic three axes of a three-dimensional drawing and the scales can be selectively set to the basic three axes which vary angularly for each three-dimensional drawing. The preset stopper corresponding to the vertical axis of the basic three axes of the three-dimensional drawing may be stationarily provided since the vertical axis is, in most cases, drawn as a vertical line. Furthermore, according to the present invention, there is provided an arrangement such that a single locking piece is engaged with or disengaged from the preset stoppers respectively corresponding to the basic three axes so that the scales may be selectively engaged with or disengaged from the respective preset stoppers which have already been angularly set. In further preferred embodiment, the angularly adjustable preset stoppers can be fixably mounted by associated clamp members on the protractor. Therefore, the basic three axes can be independently set. The present invention also enables the scales to be set by operatively associating the protractor with the scales relative to a stationary index and fixing the protractor at a desired position relative to the three axes.

Accordingly, one object of the present invention is to provide a universal parallel ruler for three-dimensional drawings which overcomes all of the previously described disadvantages present in parallel rulers of the prior art.

Another object of present invention is to provide a universal parallel ruler having a head which is further provided with preset stoppers which are adapted to be position adjustable according to the angular position of the basic three axes in the three-dimensional drawing.

A further object of the present invention relates to the provision of a single locking piece which operates a mechanism which is further engagable and disengagable with all of the aforementioned preset stoppers so that one of the scales of the parallel ruler can be set to a position corresponding to the position occupied by one of the three axes in the three-dimensional drawing.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
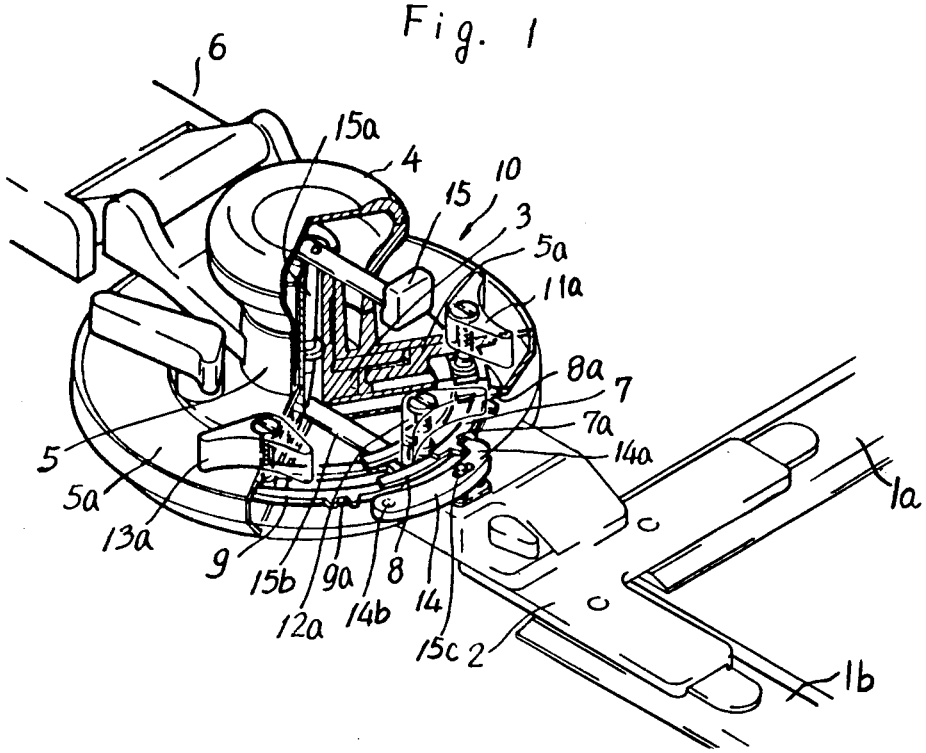
FIG. 1 is a schematic perspective view showing partially in axial section an important part of an embodiment according to the present invention.
Figure 2A:
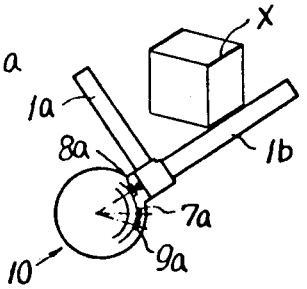
FIGS. 2*a* to 2*c* are schematic diagrams illustrating the manner of use thereof.
Figure 3A:
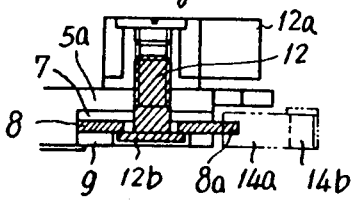
FIGS. 3*a* to 3*c* are axial sections showing in axial section the important part of the embodiment of FIG. 1 in association with FIGS. 2*a* to 2*c.
Figure 2B:
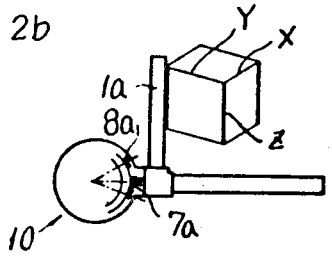
Figure 3B:
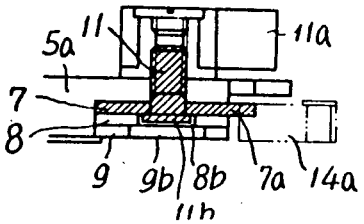
Figure 2C:
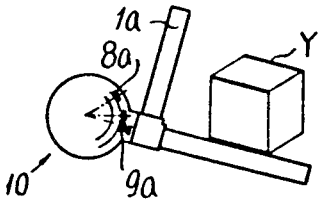
Figure 3C:
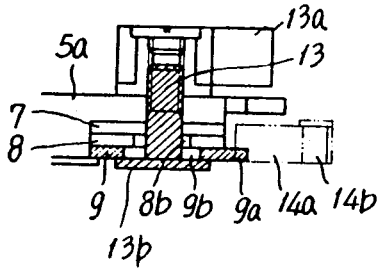
Figure 4:
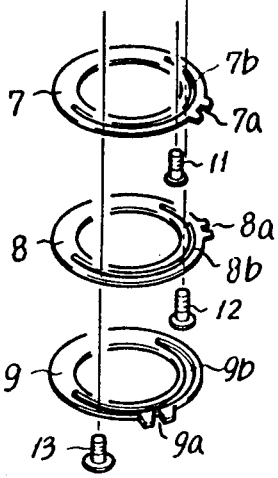
* and FIG. 4 is a dismantled perspective view showing the important part as dismantled.

Referring to FIG. 1, reference numerals 1*a*, 1*b* designate scales secured to a scale mounting plate 2 in such a manner that these scales may be maintained perpendicular to each other. It is assumed here for a convenience of illustration that the reference numeral 1*a* designates the vertical scale and the reference numeral 1*b* designates the horizontal scale. The scale mounting plate 2 is coupled by a head shaft 3 integrally to an operating head 4 and rotated by the latter. Reference numeral 5 designates a support for a head 10, which rotatably supports said head shaft 3. The head support 5 is integrally provided with a circumferentially projecting frame 5*a* around which there is provided a protractor. There is provided a vernier integrally with the scale mounting plate 2 in opposition to said protractor so that the angular positions of said scales 1*a*, 1*b* can be determined by reading the vernier's position relative to the protractor graduations. Reference numeral 6 designates a support link. Reference numerals 7, 8 and 9 designate preset stoppers, according to the present invention, respectively, which are rotatably mounted on the frame 5a of said support 5 at positions concentrically with respect to the head shaft 3. The respective preset stoppers 7, 8 and 9 are provided on the outer peripheries with engaging portions 7a, 8a and 9a by means of which the scales are respectively set to the basic three axes X, Y and Z (see FIGS. 2a, 2b and 2c) and at the intermediate concentric positions with guide grooves 7b, 8b and 9b of different widths. The respective guide grooves 7b, 8b and 9b have clamp members 11, 12 and 13, respectively, clamped therein which are individually borne in the frame 5a of the support 5. The clamp members 11 serve, as shown by FIG. 3b, to fix the preset stopper 7 by cooperating with the bottom 11b under a clamping effect of a lever 11a. The clamp member 12 serves, as shown by FIG. 3a, to fix the preset stopper 8 together with the preset stopper 7 by cooperating with the bottom 12b under the clamping effect of a lever 12a. The clamp member 13 serves, as shown by FIG. 3c, to fix the preset stopper 9 together with the preset stoppers 7 and 8 by cooperating with the bottom 13b under the clamping effect of a lever 13a. A pawl 14a of a single locking piece 14 mounted on the scale mounting plate 2 is opposed to the engaging portions 7a, 8a and 9a of the respective preset stoppers 7, 8 and 9 so that said single locking piece 14 may be selectively engaged with and disengaged from said engaging portions 7a, 8a and 9a. Such engagement and disengagement are effected by an operating lever 15 laterally projecting from the operating head 4 through linkage levers 15a, 15b and a pin 15c.

The manner of use of the universal parallel ruler according to the present invention arranged as described hereinabove will be described. Setting of the basic three axes X, Y and Z of the three-dimensional drawing is accomplished first by fixing the preset stopper 7 utilizing the clamp member 11 at the position where the vertical scale 1a coincides with the axis Z, as seen in FIGS. 2b and 3b, then by fixing the preset stopper 8 utilizing the clamp member 12 at the position where the horizontal scale 1b coincides with the X axis, as seen in FIGS. 2a and 3a, and finally by fixing the preset stopper 9 utilizing the clamp member 13 at the position where the horizontal scale 1b coincides with the Y axis as seen in FIGS. 2c and 3c, since the preset stopper 8 corresponds to the X axis, the preset stopper 9 corresponds to the Y axis and the preset stopper 7 corresponds to the Z axis in the embodiment shown. Although it is possible to set the positions of the respective engaging portions 7a, 8a and 9a by provision of a vernier for every preset stopper, it is also possible to engage the locking piece 14 with the respective engaging portions 7a, 8a and 9a and thereby bringing the scale 1a or 1b into coincidence successively with the basic three axes and fixing the respective preset stoppers, as long as the protractor and the verniers of well known types are employed.

After the preset stoppers 7, 8 and 9 have been set to the given positions corresponding to the basic three axes, the scales 1a and 1b can be selectively set to the given positions corresponding to the basic three axes by operating the lever 15 so that the locking piece 14 may be selectively engaged with or disengaged from the engaging portions 7a, 8a and 9a or the respective preset stoppers by the linkage levers 15a, 15b and the pin 15c. Furthermore, as shown by FIG. 2b, the Z axis of the basic three axes is always vertical in the ordinary three-dimensional drawing, so that the preset stopper 7 corresponding thereto may be stationarily mounted on the support 5, instead of being adjustable. In such case, the basic two axes X and Y are to be set by the preset stoppers 8 and 9 corresponding thereto, respectively, resulting in simplification of the setting procedure and of the operating mechanism.

With the universal parallel ruler for use with three-dimensional drawings according to the present invention, the preset stoppers corresponding to the basic three axes of a three-dimensional drawing, respectively, are angle adjustably mounted on the head so that the two of said basic three axes are always maintained perpendicular to each other and may be selectively set to the basic three axes, respectively. Using this invention, ellipses can be easily drawn in the basic three planes using a template without any interference with the scales and the perpendicularity of the major and minor axes of each ellipse can be simply obtained because the two scales always maintained perpendicular to each other, thereby improving the efficiency of the drawing operation. With this arrangement a single locking piece is engaged with and disengaged from the engaging portion of the respective preset stoppers for adjustably setting each of the respective scales, thereby setting each of the scales in accordance with the angular position of the basic three axes and can be effected by a single operation lever. Furthermore, the preset stoppers are successively fixed by the clamp members corresponding to the angular position of the axes of the three-dimensional drawing. Therefore, the operation of setting the respective preset stoppers can be efficiently performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A universal parallel ruler having a plurality of scales attached thereto for use in drawings having a plurality of axes, comprising:

a head means operatively connected to said scales for guiding said scales of said ruler to the proper location on said drawing; and a plurality of preset stopper means angle-adjustably mounted within said head means, all of said preset stopper means being provided for angularly adjusting said scales of said parallel ruler to a desired angle, one of said preset stopper means being angularly adjusted and fixedly set to a first desired angle, the remaining ones of said plurality of preset stopper means being angularly adjusted and fixedly set to desired angles different from said first desired angle;

whereby said desired angles may be adapted to correspond to the axes of a three-dimensional drawing.

2. The universal parallel ruler in accordance with claim 1 wherein each of said preset stopper means comprises a body portion and an engaging means projecting outwardly from said body portion of said preset stopper means.

3. The universal parallel ruler in accordance with claim 1 further comprising:

locking piece means engagable with each of said preset stopper means for locking one of said scales of said parallel ruler in juxtaposition with one of said desired angles.

4. The universal parallel ruler in accordance with claims 1, 2, or 3 further comprising:

a plurality of clamp member means engagable with each of said angularly-adjustable preset stopper means, each of said clamp member means fixedly mounting each of said preset stopper means within said head means, each of said clamp member means clamping each of said preset stopper means into a fixed angular position independent of the positions of the other of said preset stopper means, wherein each of said preset stopper means is adapted to be independently angularly adjusted to align with one of said axes of a three-dimensional drawing.

5. The universal parallel ruler in accordance with claim 4 further comprising:

a protractor mounted to said head means, said protractor indicating the angle said scales are set to.

6. The universal parallel ruler in accordance with claim 5 wherein each of said clamp member means includes an operator actuable lever for locking said clamp member means, said clamp member means being located so that the operator actuable lever of each of said clamp means indicates the angular position in which said scales will lock when said preset stopper means corresponding to that clamp member means is engaged.

7. The universal parallel ruler in accordance with claim 3 further comprising:

locking piece disengagement means centrally located on said head means to facilitate one handed operation, said locking piece disengagement means for disengaging said locking piece means from one of said preset stopper means.

8. A universal parallel ruler having a plurality of scales attached thereto for use in drawings having a plurality of axes, comprising:

a head means operatively connected to said scales for guiding said scales of said ruler to the proper location on said drawing;

a plurality of preset stopper means angle-adjustably mounted within said head means, said stopper means being provided for angularly adjusting said scales to desired angles; and a plurality of clamp member means engagable with each of said angularly-adjustable preset stopper means, each of said clamp member means for fixedly mounting each of said head means, each of said clamp member means clamping each of said preset stopper means into a fixed angular position independent of the positions of the other of said preset stopper means;

wherein each of said preset stopper means is adapted to be independently angularly adjusted to align with one of said axes of a three-dimensional drawing.

9. A universal parallel ruler having a plurality of scales attached thereto for use in drawings having a plurality of axes, comprising:

a head means operatively connected to said scales for guiding said scales of said ruler to the proper location on said drawing;

a plurality of preset stopper means angle-adjustably mounted within said head means, said stopper means being provided for angularly adjusting said scales to desired angles;

a plurality of clamp member means engagable with each of said angularly-adjustable preset stopper means, each of said clamp member means for fixedly mounting each of said preset stopper means within said head means; and a protractor mounted to said head means, said protractor indicating the angle said scales are set to;

wherein each of said clamp member means includes an operator actuable lever for locking said clamp member means, said clamp member means being located so that the operator actuable lever of each of said clamp means indicates the angular position in which said scales will lock when said preset stopper means corresponding to that clamp member is engaged.

10. A universal parallel ruler having a plurality of scales attached thereto for use in drawings having a plurality of axes, comprising:

a head means operatively connected to said scales for guiding said scales of said ruler to the proper location on said drawing;

a plurality of preset stopper means angle-adjustably mounted within said head means, said stopper means being provided for angularly adjusting said scales to desired angles;

locking piece means engagable with each of said preset stopper means for locking one of said scales of said parallel ruler in juxtaposition with one of said desired angles; and locking piece disengagement means centrally located on said head means to facilitate one handed operation, said locking piece disengagement means for disengaging said locking piece means from one of said preset stopper means.

* * * * *

UNITED STATES PATENT AND TRADEMARK OFFICE

CERTIFICATE OF CORRECTION

PATENT NO. : 4,206,551

DATED : June 10, 1980

INVENTOR(S) : Matsugu et al

It is certified that error appears in the above-identified patent and that said Letters Patent are hereby corrected as shown below:

In the category of Inventors:

Please delete "Asahi Seimitsu Kabushiki Kaisha, 03, Tokyo, Japan"

Signed and Sealed this

*Nineteenth* Day of *August 1980*

[SEAL]

*Attest:*

SIDNEY A. DIAMOND

*Attesting Officer*

*Commissioner of Patents and Trademarks*